US011459862B2

(12) United States Patent
Watson

(10) Patent No.: US 11,459,862 B2
(45) Date of Patent: Oct. 4, 2022

(54) WELL OPERATION OPTIMIZATION

(71) Applicant: Silverwell Technology Ltd., Histon (GB)

(72) Inventor: Peter John Watson, Foxton (GB)

(73) Assignee: SILVERWELL TECHNOLOGY LTD., Cambridgeshire (GB)

( * ) Notice: Subject to any disclaimer, the term of this patent is extended or adjusted under 35 U.S.C. 154(b) by 277 days.

(21) Appl. No.: 16/778,983

(22) Filed: Jan. 31, 2020

(65) Prior Publication Data

US 2021/0238970 A1 Aug. 5, 2021

(51) Int. Cl.

| | |
|---|---|
| ***E21B 43/12*** | (2006.01) |
| ***E21B 21/08*** | (2006.01) |
| ***F04B 47/12*** | (2006.01) |
| ***F04B 49/08*** | (2006.01) |

(52) U.S. Cl.

CPC ..... *E21B 43/129* (2013.01); *E21B 21/08* (2013.01); *E21B 43/123* (2013.01); *F04B 47/12* (2013.01); *F04B 49/08* (2013.01); *F04B 2205/09* (2013.01); *F04B 2207/0411* (2013.01)

(58) Field of Classification Search

CPC ..... F04B 47/12; F04B 49/08; F04B 2205/09; F04B 2207/0411; E21B 21/08; E21B 43/129; E21B 43/123

See application file for complete search history.

(56) References Cited

U.S. PATENT DOCUMENTS

| | | | | |
|---|---|---|---|---|
| 4,633,954 A | | 1/1987 | Dixon et al. | |
| 4,721,158 A | * | 1/1988 | Merritt, Jr. | E21B 43/12 166/250.01 |
| 4,921,048 A | | 5/1990 | Crow et al. | |
| 5,597,042 A | | 1/1997 | Tubel et al. | |
| 5,634,522 A | * | 6/1997 | Hershberger | E21B 47/009 166/372 |
| 5,735,346 A | * | 4/1998 | Brewer | E21B 47/047 166/250.03 |
| 6,719,060 B1 | | 4/2004 | Wells | |
| 6,883,606 B2 | | 4/2005 | Evans et al. | |
| 9,644,462 B2 | | 5/2017 | Green | |

(Continued)

FOREIGN PATENT DOCUMENTS

CN 109209304 A 1/2019

OTHER PUBLICATIONS

United Kingdom Search Report dated Sep. 27, 2021; Application No. GB2101033.5.

*Primary Examiner* — Connor J Tremarche
(74) *Attorney, Agent, or Firm* — Bracewell LLP; Constance G. Rhebergen; Keith R. Derrington

(57) ABSTRACT

Fluid is produced from a well that is equipped with a plunger lift system. The plunger lift system includes a plunger that is inserted into production tubing that is installed in the well. Liquid from a surrounding formation accumulates on top of the plunger. The liquid accumulation on the plunger is monitored. Lift gas is injected into the production tubing below the plunger to lift the plunger and accumulated liquid to surface. A wellhead assembly at surface directs the accumulated liquid away from the well, and injection of the lift gas is suspended to allow the plunger to drop back to its initial position. The timing of the lift gas injection is based on monitoring liquid accumulation, and also to maximize production from the well.

20 Claims, 8 Drawing Sheets

(56) References Cited

U.S. PATENT DOCUMENTS

| | | | |
|---|---|---|---|
| 2002/0074118 | A1 | 6/2002 | Fisher |
| 2008/0202746 | A1 | 8/2008 | Mudry |
| 2017/0175503 | A1 | 6/2017 | Scantlebury |
| 2017/0356278 | A1 | 12/2017 | Nandola et al. |
| 2018/0171765 | A1 | 6/2018 | Elmer |

* cited by examiner

WELL OPERATION OPTIMIZATION

BACKGROUND OF THE INVENTION

1. Field of Invention

The present disclosure relates to maximizing a rate of fluid produced from a gas assisted well.

2. Description of Prior Art

Hydrocarbons trapped in a subterranean formations are typically accessed and produced through wells drilled into the formations. Production tubing is usually installed in the well that provides a conduit for directing produced fluids out of the well. Some formations have sufficient pressure to drive liquid and gas hydrocarbons to surface, while others have insufficient pressure to lift the liquids to surface and will require lift assistance in the well. Lift assistance is often referred to as artificial lift; some common types of artificial are electrical submersible pumps, sucker rod pumping, gas lift, progressive cavity pumps, and plunger lift. Because pressure in the formation drops as the hydrocarbons become depleted from within the formation, some wells will require artificial lift at later stages of the life of the well.

Plunger lift systems typically employ a plunger that is supported at a particular depth inside the production tubing. Liquid hydrocarbons being produced from the well flow into the production tubing and upward around or through the plunger. A column of the liquid hydrocarbons accumulates above the plunger inside the production tubing. Periodically gas from surface is injected into the production tubing and below the plunger, which forces the plunger and the column of liquid hydrocarbons to a wellhead assembly on surface. From inside the wellhead assembly the liquid hydrocarbons flow into a production line, which directs the liquid hydrocarbons away from the wellsite for collection and/or processing. Shortcomings of the plunger lift systems is that their operations do not consider conditions affecting production rates of the associated wells.

SUMMARY OF THE INVENTION

Disclosed herein is an example method of producing from a wellbore that includes receiving into the wellbore a flow of fluid having a liquid, and that forms an accumulation of liquid on a plunger in the wellbore, producing the liquid from the wellbore with cycles of lift gas injection into the wellbore that lift the plunger and accumulation of liquid to surface, obtaining an anticipated rate of liquid into the wellbore, identifying times for initiating the cycles to produce a maximum amount of the liquid based on the anticipated rate of flow of liquid into the wellbore, and maximizing a rate of liquid being unloaded from the wellbore by initiating the cycles at the identified times. The anticipated rate of flow of liquid is optionally based on static head pressure of the accumulation of liquid on the plunger. In an example, the static head pressure is monitored over time, and a subsequent cycle is initiated when a rate of change of the static head pressure over time approaches unity. Optionally, the anticipated rate of flow of liquid is based on historical data. In one alternative, a subsequent cycle is initiated when the anticipated rate of flow of liquid approaches zero. In one embodiment, the plunger is disposed in production tubing that is installed in the wellbore, and wherein the static head pressure is monitored by sensing pressure inside the production tubing. In an example, lift gas is injected into the production tubing below the plunger. Lift gas is optionally maintained in an annulus between the production tubing and sidewalls of the wellbore during and between cycles of lift gas injection. In an alternative, also included in the fluid is a produced gas that flows with the liquid from a formation adjacent the wellbore, and where the liquid and the produced gas each have hydrocarbons. Further optionally, a wellhead assembly is provided on surface at an upper end of production tubing disposed in the wellbore, and where the accumulation of liquid and produced gas flow through the production tubing and to the wellhead assembly.

Another method of producing from a wellbore is disclosed which includes obtaining flowrates of a liquid accumulating in the wellbore over a period of time that the wellbore is being loaded with the liquid, estimating rates of liquid production from the wellbore by initiating a cycle of unloading the wellbore for the flowrates of the liquid accumulating in the wellbore, identifying a maximum from the rates of liquid production from the wellbore to define a maximum liquid production rate, identifying a flowrate of the liquid accumulating in the wellbore that corresponds to the maximum liquid production rate to define a target flowrate, monitoring conditions in the wellbore to obtain an estimate of a current flowrate of liquid accumulating in the wellbore, and using a plunger and lift gas to unload liquid accumulated in the wellbore when the current flowrate of liquid accumulating in the wellbore is about the same as the target flowrate. In one embodiment, the plunger is disposed in production tubing installed in the wellbore, and where conditions in the wellbore are monitored with a pressure sensor that is in communication with the production tubing. Flowrates of a liquid accumulating in the wellbore are optionally obtained over a period of time where changes in a liquid level of the liquid accumulating in the wellbore are estimated based on monitoring pressure in the wellbore over the period of time, and correlating the flowrate of the liquid accumulating in the wellbore to the liquid level changes. The flowrates are obtained in real time in one example and obtained from historical data in another. In an alternative, the plunger is disposed in production tubing installed in the wellbore, and where lift gas is maintained in an annulus between the production tubing and sidewalls of the wellbore prior to and after the step of unloading. In an example, the plunger is disposed in production tubing installed in the wellbore, and the lift gas is introduced into the production tubing from an annulus between the production tubing and sidewalls of the wellbore through a valve that is selectively actuated in response to a command.

BRIEF DESCRIPTION OF DRAWINGS

Some of the features and benefits of the present invention having been stated, others will become apparent as the description proceeds when taken in conjunction with the accompanying drawings, in which.

Figure 1:
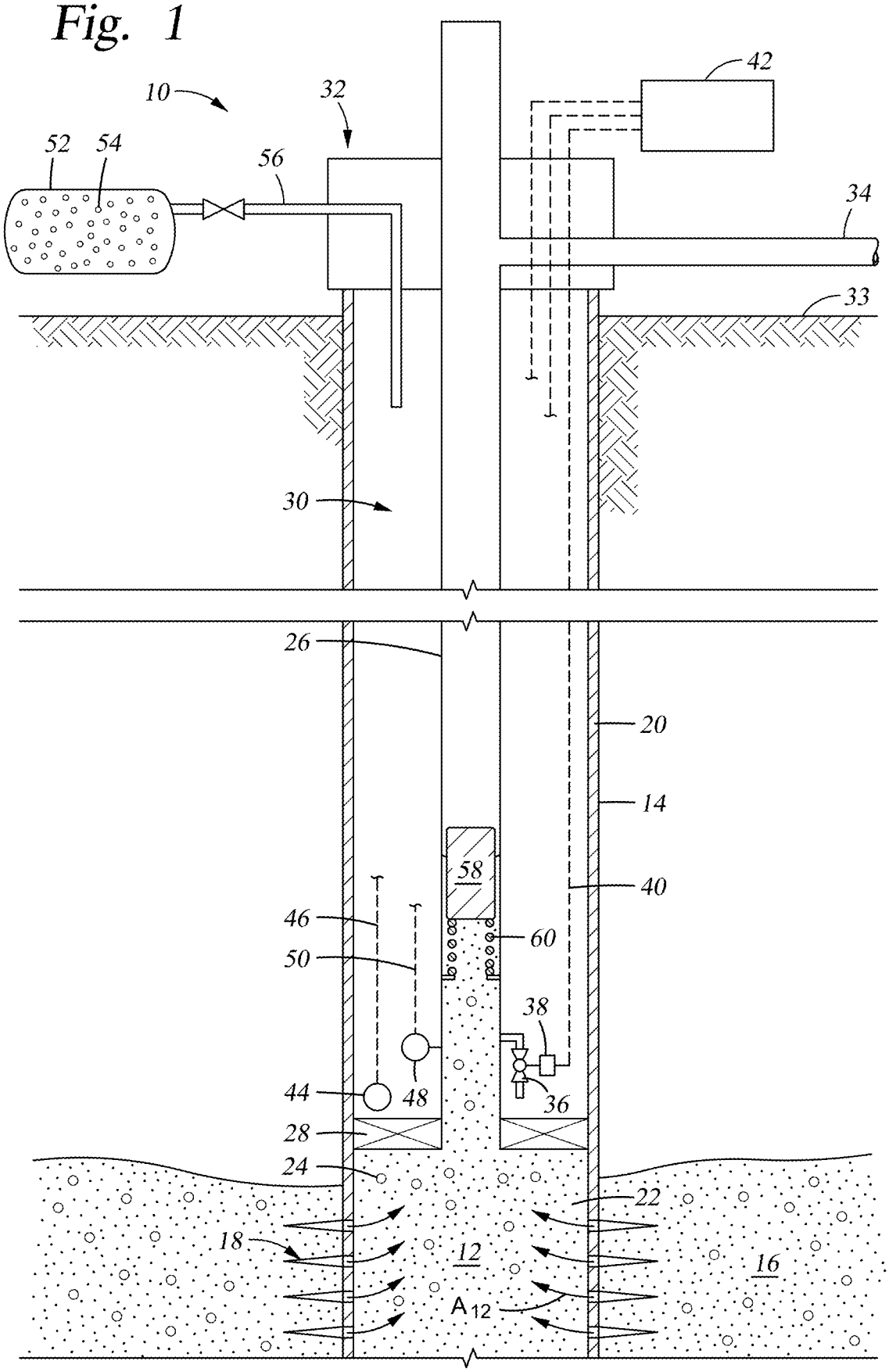
FIG. 1 is a side partial sectional view of an example of a hydrocarbon producing wellbore equipped with a plunger lift system that includes a plunger.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, the terms "about" and "substantially" include +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in a partial side sectional view in FIG. 1 is an example of a system 10 for producing fluid 12 from a wellbore 14. In the illustrated example, wellbore 14 intersects a subterranean formation 16 and receives fluid 12 from the formation through perforations 18 shown projecting radially outward from the wellbore 14 into the formation 16. Further in the example is an annular string of casing 20 that lines the wellbore 14 and provides selective isolation between the formation 16 and wellbore 12. As shown, the perforations 18 penetrate the casing 20 also. In an alternative, system 10 is deployed in an open hole wellbore (not shown). Fluid 12 is shown to include liquid 22 and gas 24, and which are selectively conveyed to surface within an annular string of production tubing 26 depicted installed within the wellbore 14. Further in this example, a packer 28 is installed in an annulus 30 between the production tubing 26 and sidewalls of wellbore 14. The packer 28 forms a barrier to the passage of fluid 12 into annulus 30, and directs fluid 12 into a lower end of production tubing 26. In the illustrated embodiment packer 28 is disposed proximate a lower end of tubing 26; but options exist for placement of packer 28 at varying depths within annulus 30. Also included in the illustrated embodiment of the system 10 is a wellhead assembly 32 shown mounted on surface 33 above an opening of wellbore 14, and which receives an upper end of production tubing 26. An end of a production line 34 is shown mounted in wellhead assembly 32. In an example of operation, fluid 12 being produced from wellbore 14 is directed within tubing 26 to wellhead assembly 32 and into production line 34; fluid 12 is transported away from the wellbore 14 inside production line 34 for collection and/or processing.

An injection valve 36 is illustrated in FIG. 1 within annulus 30 and mounted to an outer surface of production tubing 26. In an example, injection valve 36 provides selective communication between annulus 30 and inside of production tubing 26. In the illustrated example a valve actuator 38 is coupled with injection valve 36, and which provides selective actuation of injection valve 36. In the embodiment of FIG. 1, a control line 40 is schematically depicted that connects between the valve actuator 38 and a controller 42 on the surface. In one example, the injection valve 36 is actuated in response to commands from the controller 42 conveyed or transmitted along or through control line 40. In one alternate embodiment, operations personnel initiate a signal that is transmitted through control line 40 and received by valve actuator 38 having a command or direction to actuate injection valve 36. Examples of actuation include opening the valve 36, closing the valve 36, and setting the valve 36 in a partially open configuration. A pressure sensor 44 is included in the example of FIG. 1 and is shown disposed within the annulus 30, pressure sensor 44 of this example is equipped with the means for sensing pressure within annulus 30. As shown, a control line 46 couples between sensor 44 and controller 42, and in an embodiment provides signal communication between the pressure sensor 44 and the controller 42. In the illustrated example, a sensor 48 is shown in annulus that is in communication with the inside of the production tubing 26. In an embodiment, the sensor 48 senses pressure, temperature, or both. A control line 50 is schematically represented connected between sensor 48 and controller 42, and that in an embodiment provides signal communication between the sensor 48 and controller 42. In an example, control lines 40, 46, 50 are made up of conductive materials, fiber optics, composites, or combinations thereof; and in an alternative, signals between surface and downhole are conveyed wirelessly or via telemetry.

Still referring to FIG. 1, included in this example is a lift gas source 52 containing lift gas 54, and which are shown on surface. In an alternative, lift gas 54 originates from within well 14 and/or from wells (not shown) proximate to location of wellbore 14. Examples exist where lift gas source 52 is a container such as a vessel or tank, a compressor, a transmission line, or another well. A lift gas injection line 56 is included in the illustrated embodiment and shown having an end connected to a discharge of lift gas source 52. In an example lift gas injection line 56 provides a conduit for delivering lift gas 54 from lift gas source 42 and to the annulus 30. In one example, lift gas 54 is maintained in the annulus 30 during all stages of operation of the system 10. Further optionally, the pressure of the gas 54 in the annulus 30 is maintained at an amount so that it is adequate for injection into the production tubing 26. It is within the capabilities of those skilled in the art to determine a pressure suitable for injection into the production tubing 26. For the purposes of discussion herein, the term "above" when used in conjunction to describe an item or items inside the wellbore 14 or formation 16, means a location or a direction relative to the item or items that is towards surface 33. Also for the purposes of discussion herein, the term "below" when used in conjunction to describe an item or items inside the wellbore 14 or formation 16, means a location or a direction relative to the item or items that is away from surface 33.

The example system 10 of FIG. 1 is equipped with components for unloading the wellbore 14; an example of unloading the wellbore 14 includes lifting liquid accumulated in the wellbore 14 to the wellhead assembly 32. In the example of FIG. 1, a plunger 58 is disposed within production tubing 26 and shown resting on a spring 60 that is mounted within production tubing 26. The plunger 58 in combination with the lift gas 54 provides an example means for lifting the liquid 22 to surface; which in one alternative is employed when fluid 12 being produced in wellbore 14 is at a pressure which is insufficient to drive the liquid 22 up the wellbore 14 and to the wellhead assembly 32.

Figure 2:
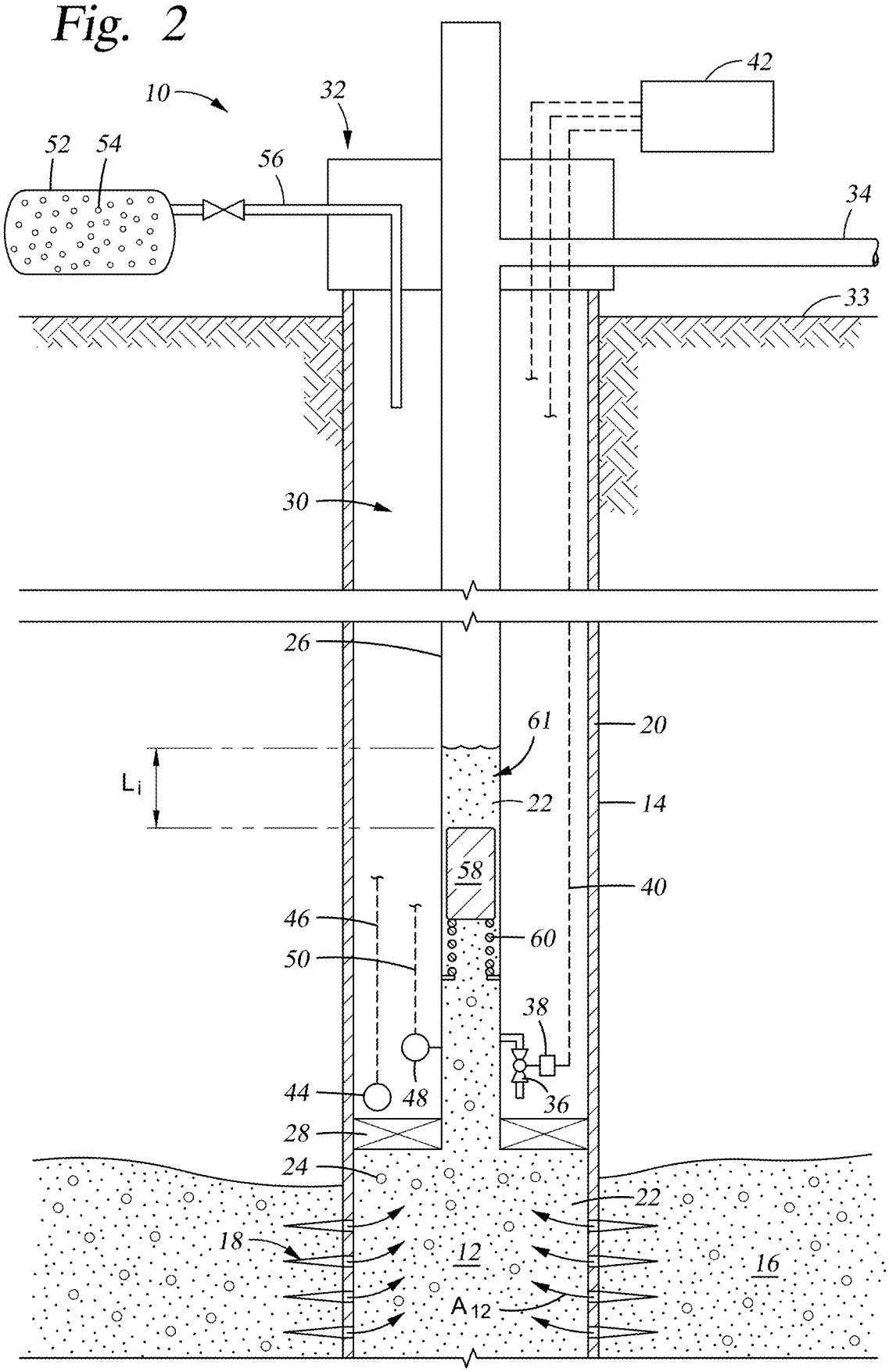
FIGS. 2 and 3 are side partial sectional views of the hydrocarbon producing wellbore of FIG. 1 with liquid accumulating on the plunger.

In a non-limiting example of unloading the wellbore 14 and/or operation of the system 10, the plunger 58 is cycled within the production tubing 26, and with each cycle an amount of the liquid 22 is produced from the wellbore 14. Illustrated in FIGS. 1-6 are example stages or steps of a method of unloading the wellbore 14. In FIG. 1 is an example of a portion of a "buildup" stage, in which a pressure difference between the formation 16 and wellbore 14 results in fluid 12 (illustrated by arrows Au) flowing from the formation 16 into the wellbore 14 and through the perforations 18. The plunger 58 as shown in FIG. 1 is partially submerged in the liquid 22. A subsequent example stage of the unloading method is depicted in FIG. 2, which in this example, the pressure in formation 16 is also greater than that in production tubing 26 and the resulting pressure differential causes liquid 22 to flow into production tubing 26 and upwards past plunger 58. Over time the liquid 22 accumulates on top of plunger 58 as a liquid column 61 (or accumulation of liquid) shown having a height represented by $L_i$. For the purposes of simplicity, in the example of FIG. 2 the liquid column 61 is illustrated being substantially all liquid 22 and generally without any gas 24. In an alternative (not shown), the liquid column 61 includes varying amounts of gas 24.

Figure 3:
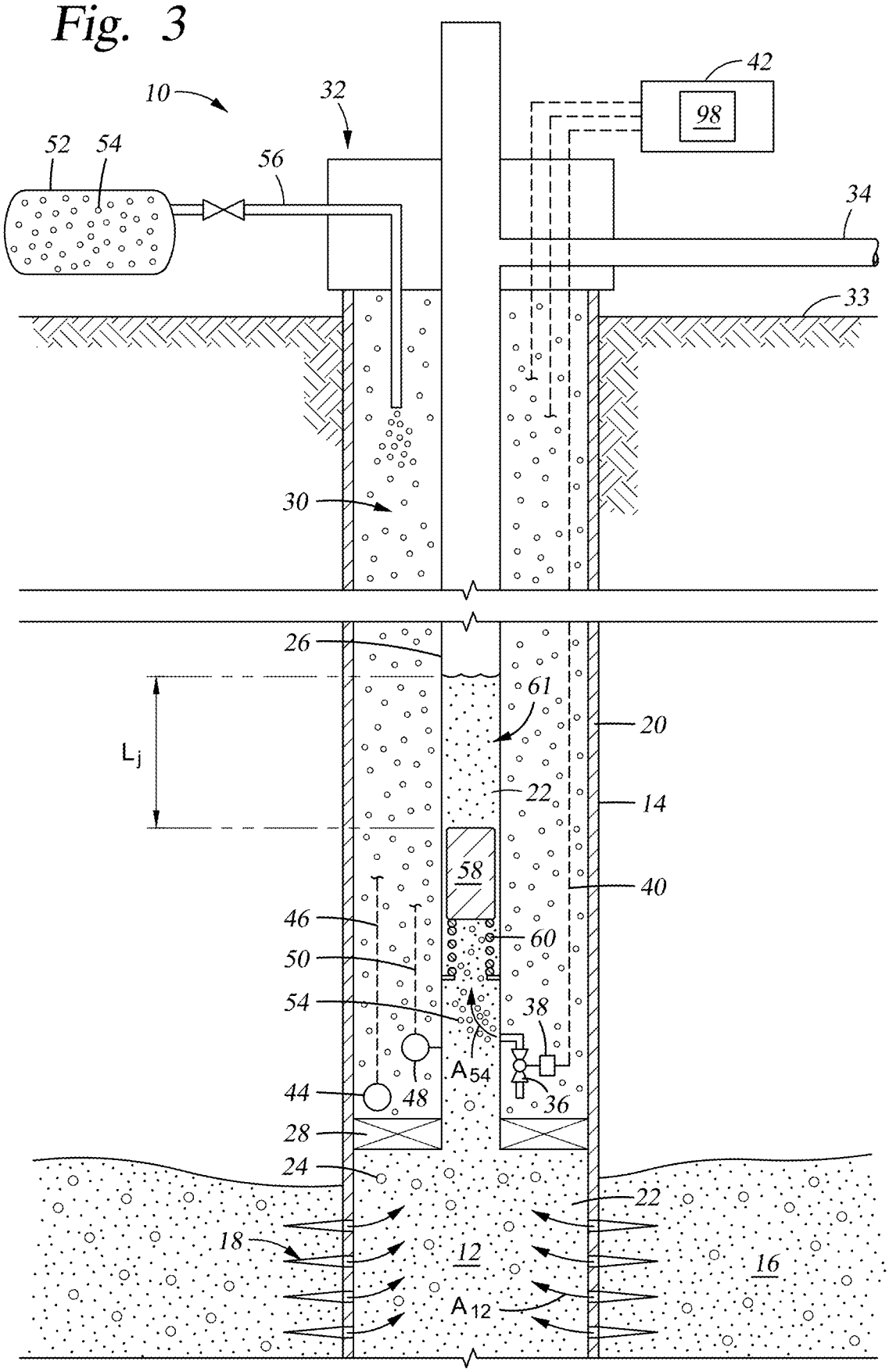

Depicted in partial side sectional view in FIG. 3, is an example of a stage of operation of the system 10 or method subsequent to that of FIG. 2. In the example of FIG. 3, the fluid 12 continues to flow into wellbore 14 as represented by arrows Au, and introduces an additional amount of liquid 22 into the wellbore 14 and that flows upward into production tubing 26 past plunger 58. In this example, the length of the liquid column 61 has increased over that of FIG. 2, and is represented by $L_j$. As described in more detail below, in an example of operation maximum height of the liquid column 61 is limited by the pressure differential between the formation 16 and production tubing 26 and pressure losses experience by the fluid 12 by flowing into the production tubing.

Figure 4:
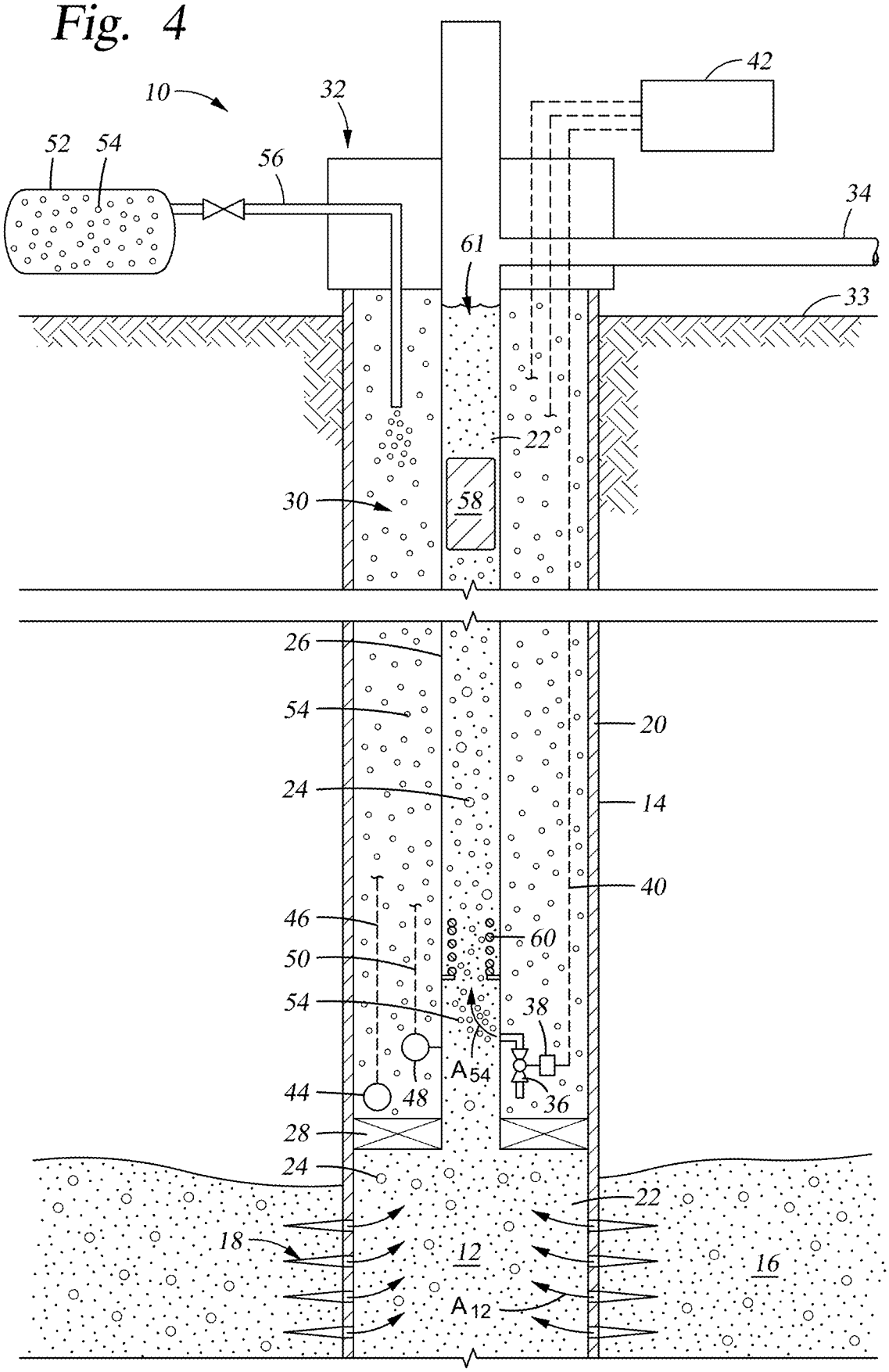
FIGS. 4 and 5 are side partial sectional views of the example hydrocarbon producing wellbore of FIG. 1 in which the plunger and a column of produced fluid on the plunger are shown being lifted by injected gas.

Also shown in the example of FIG. 3 is that an amount of lift gas 54 has been injected into production tubing 26 for selective lifting of the liquid column 61 to the wellhead assembly 32. In an example, this occurs by initiating a signal from controller 42 to actuator 38 to open the injection valve 36 to introduce lift gas 54 into the production tubing 26 and below the plunger 58. As illustrated in FIG. 4, continued injection of the lift gas 54 from the annulus 30 through the injection valve 36 and into production tubing 26 disposes an amount of lift gas 54 below the plunger 58 and liquid column 61. The pressure of the lift gas 54 is higher than that exerted by the plunger 58 and liquid column 61, and a buoyancy force urges the lift gas 54 upward in the production tubing 26 towards the wellhead assembly 32. The buoyancy forces are transferred to the plunger 58 via contact between the lift gas 54 and plunger 54, which in turn urges the plunger 58 and liquid column 61 within production tubing 26 and be delivered to the wellhead assembly 32.

Figure 5:
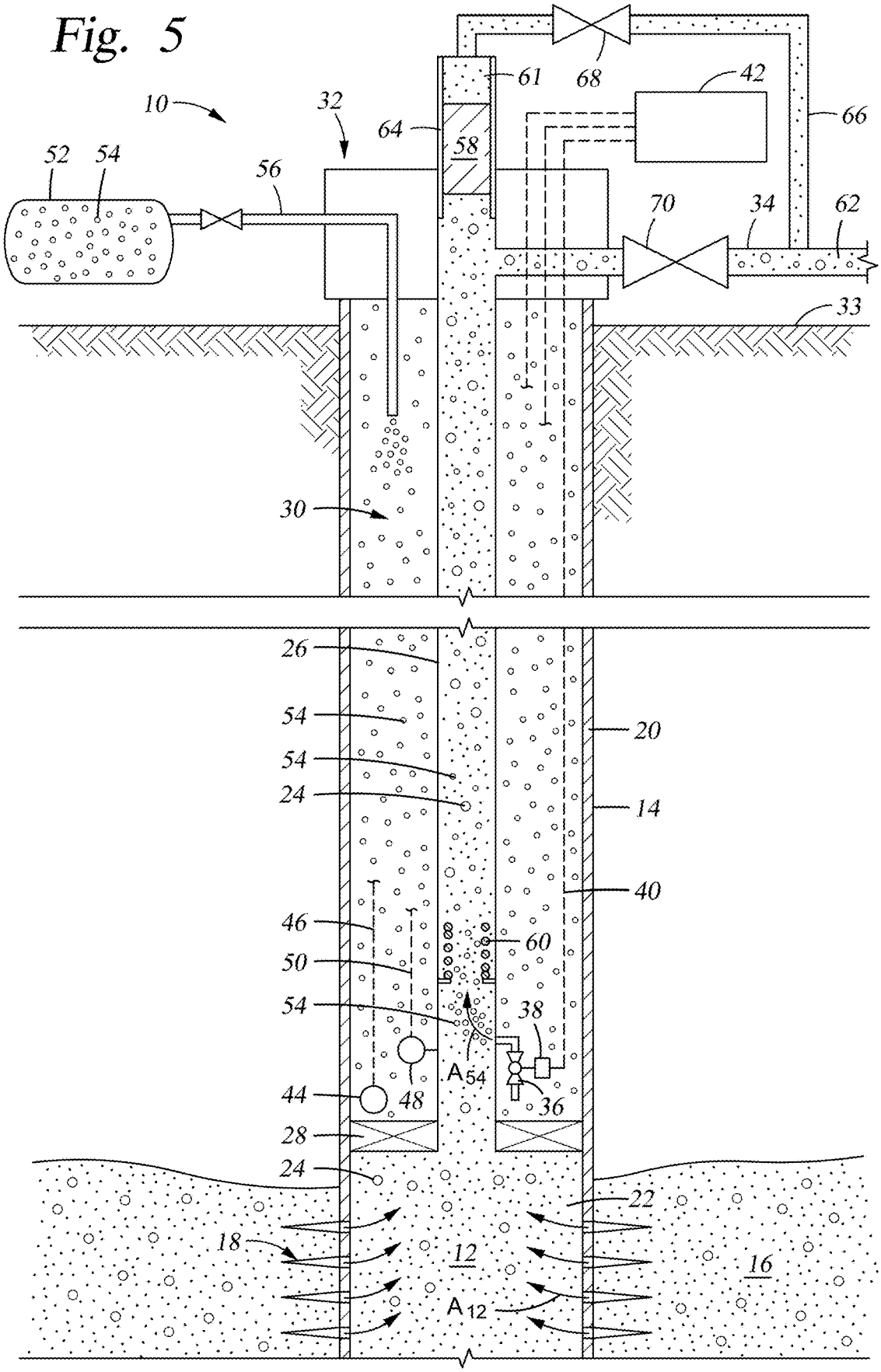

Illustrated in FIG. 5 is an example step of producing from the wellbore 14 in which the liquid 24 is being directed into the production line 34 from the production tubing 26. Depicted in this example the injection of the lift gas 54 has urged the plunger 58 upward through the production tubing 26 to inside of the wellhead assembly 32; and which directs the column 61 into the production line 32. For the purposes of discussion herein, when inside the production line 32 the liquid 22 is referred to as production fluid 62. In an alternative, an example of a lubricator 64 is provided on an upper end of production tubing 26 within wellhead assembly 32. Liquid 22 making up the liquid column 61 inside the lubricator 64 is routed through a bypass line 66 into the production line 34. Optional block valves 68, 70 are respectively provided in the bypass line 66 and production line 34.

Figure 6:
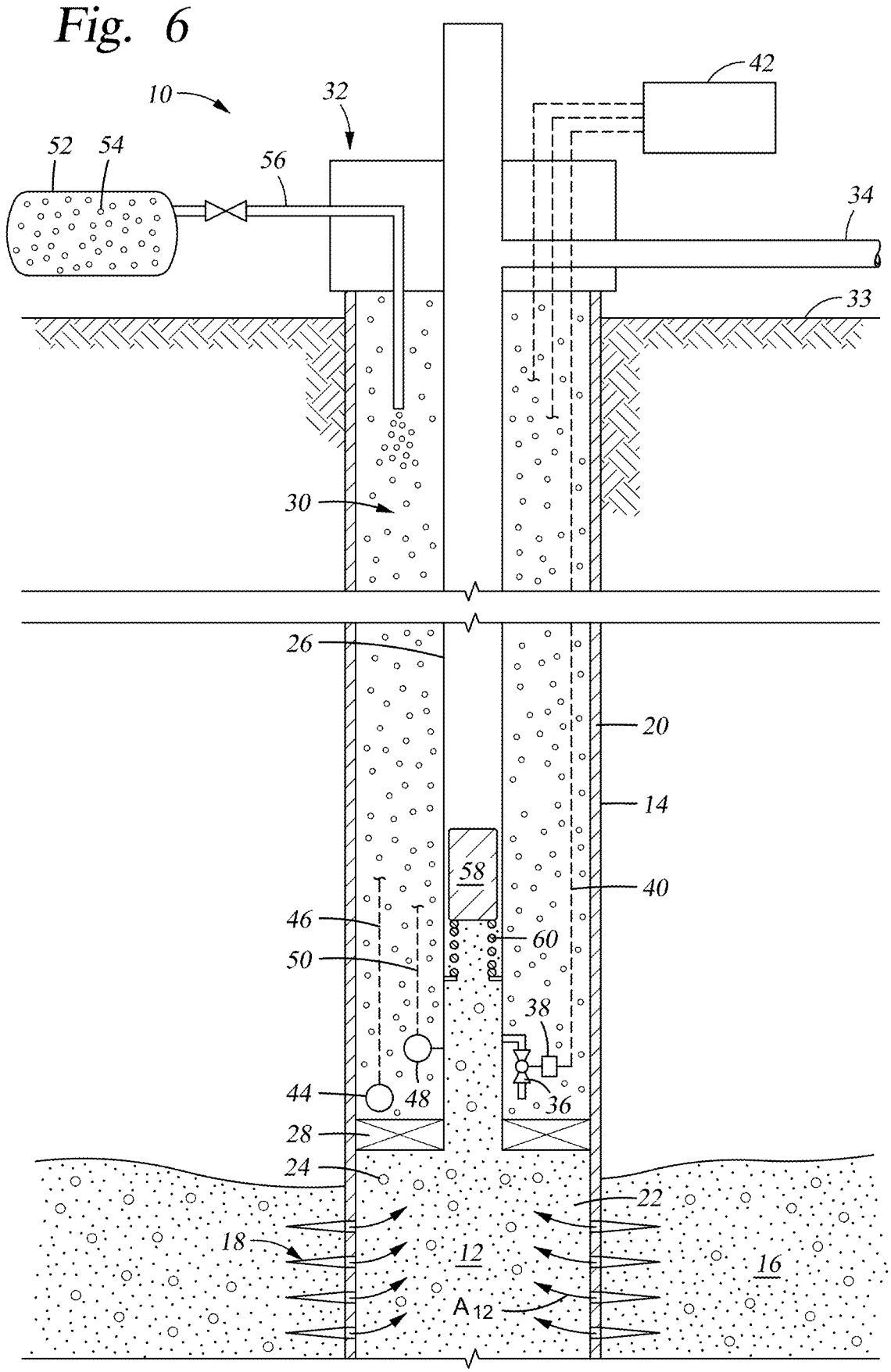
FIG. 6 is a side partial sectional view of the example hydrocarbon producing wellbore of FIG. 5 depicted after a suspension of gas injection and the plunger returned to the position of FIG. 1.

Illustrated in the example of FIG. 6 is that after lifting the liquid column 61, the supply of lift gas 54 into the production tubing 26 is suspended; which allows plunger 58 to drop back onto spring 60. In an example of operation, suspending the supply of lift gas 54 includes closing the injection valve 36 by sending a signal to the actuator 38 via line 40. Embodiments exist that the signal is initiated by operations personnel, or automatically generated by a processor through automated control or in response to a sensed condition in the wellbore 14.

Figure 7:
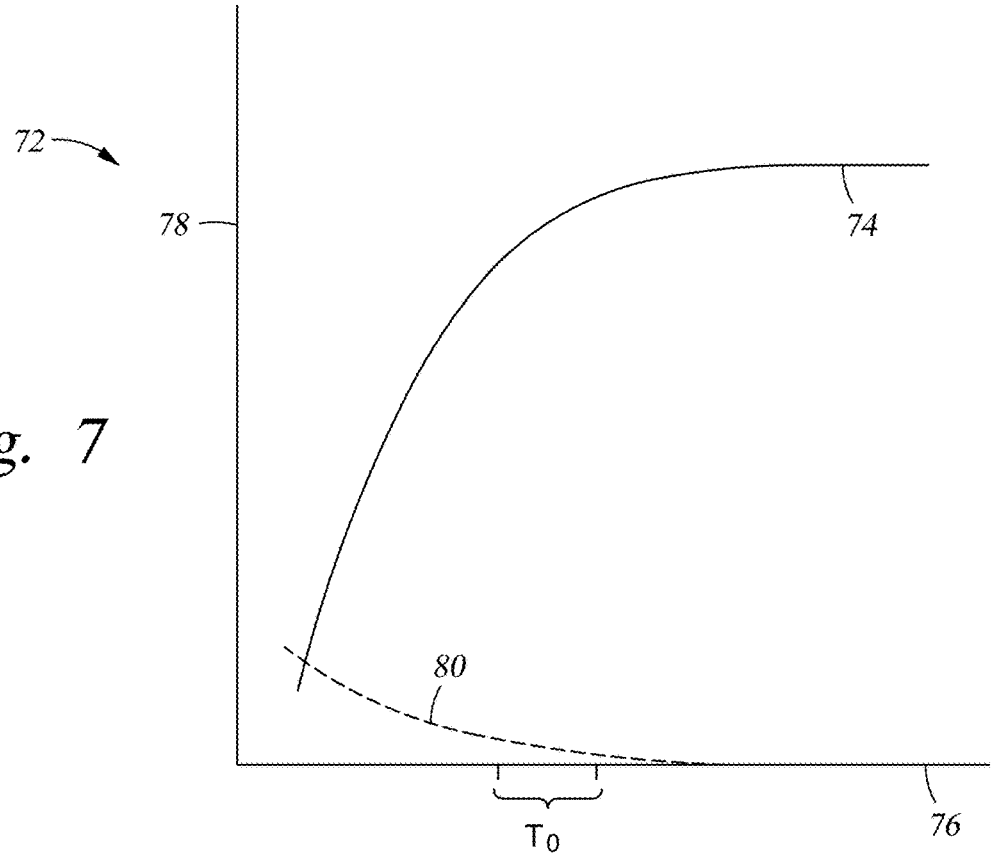
FIG. 7 is a graphical representation of an example of pressure at the plunger over a period of time.

Referring now to FIG. 7, a plot 72 is shown that includes a curve 74 which graphical represents prophetic values of pressure within the production tubing 26 as the liquid column 61 is accumulating on top of the plunger 58 (FIGS. 2 and 3). Time is represented along abscissa 76, and pressure represented along the ordinate 78. In an example the pressure is measured by sensor 48 (FIG. 3). For the purposes of discussion herein, it is assumed that the changes of pressure reflected in FIG. 7 are due primarily to the buildup of liquid 22 in the production tubing 26 over time. It is further assumed that the buildup of liquid 22 contains an insubstantial amount of gas 24, so that changes in pressure over time depicted in curve 74 reasonably infer the flowrate of the liquid 22 into that buildup. A curve 80 is also included in plot 72 that represents a flowrate of liquid 22 into the wellbore 14, and which is considered to be the same as a flowrate of liquid 22 accumulating on the plunger 58. Flowrate of the liquid 22 is represented along ordinate 78. Curve 80 is based on changes in pressure over time, that correlate to static head and a known volume inside production tubing 26. In an example, as the flowrate of the liquid 22 changes over time and because curves 74, 80 provide information over the entire buildup time of liquid 22 entering the wellbore 14, the curves 74, 80 also provide an anticipated rate of flow of liquid 22 into the wellbore 14. In an example, height of the liquid column 61 is estimated based on a curve of pressure over time similar to that provided in FIG. 7.

As noted above, the height of the liquid column 61 is dependent on a pressure difference between the formation 16 and inside the tubing 26. Ignoring dynamic pressure losses incurred by the liquid 22 flowing from the formation 16 into the production tubing 26, the flow of liquid 22 into the wellbore 14 from the formation 16 will cease when the buildup of the liquid column 61 reaches a height such that static head of the liquid 22 at an upper end of the perforations 18 substantially matches the pressure difference between the production tubing 26 and formation 16. As the magnitude of the flowrate is governed by a pressure differential between the formation 16 and inside the wellbore 14, the flowrate of the liquid 22 significantly reduces for a period of time prior to when the pressures equalize. In the example of FIG. 7 this is represented where curve 74 becomes parallel with abscissa 76 and curve 80 approaches zero. Further illustrated in curve 80 is that the flowrate of the liquid 22 approaches zero around the same time span of the "knee" of curve 74; which is also about where the slope of curve 74 transitions downward to zero and then to lesser values over time. In an example, a total buildup time describes a time span that starts when there is no liquid above a point where the pressure is being monitored and ends when liquid stops flowing into the wellbore 14. Based on the curves 74, 80, a majority of the liquid buildup occurs early in this time span, and is negligible over a large part of the time span.

Figure 8:
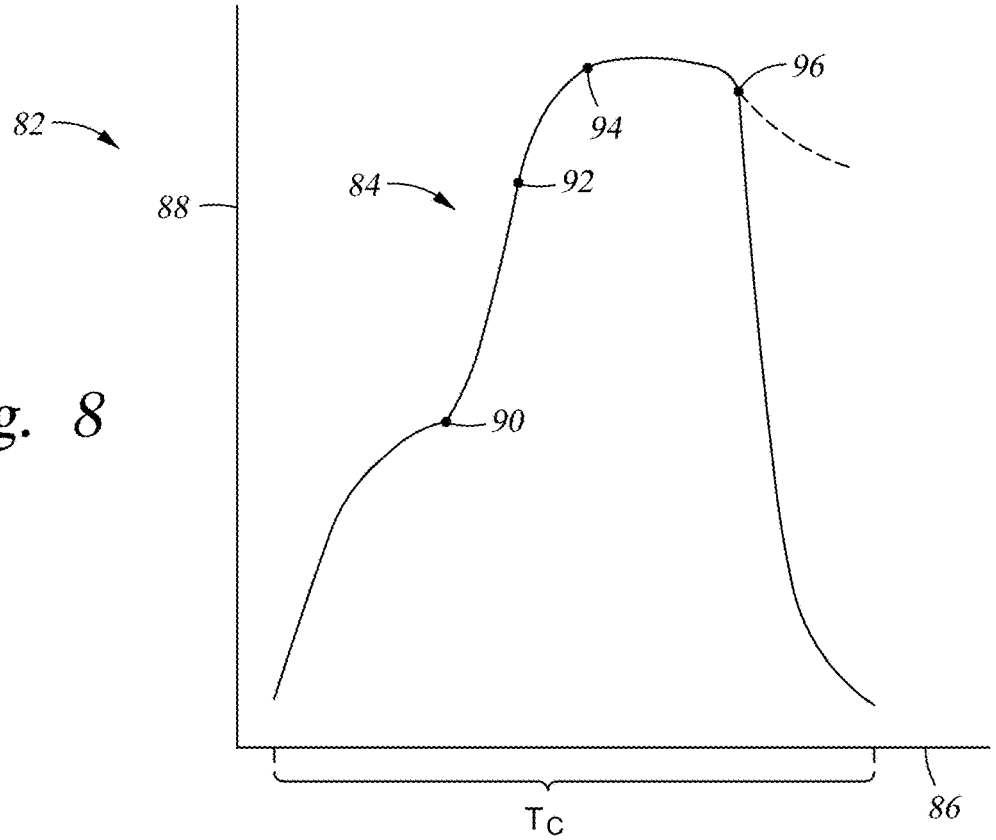
FIG. 8 is a graphical representation of an example of pressure in the hydrocarbon producing wellbore during a plunger lift cycle.

Referring now to FIG. 8, a plot 82 is illustrated having a curve 84 that graphically represents a recorded pressure within wellbore 14 (FIGS. 1-6) during a cycle of lifting liquid 22 from the wellbore 14 to produce fluid from the wellbore 12. Also in plot 82 is an abscissa 86 that represents time, and an ordinate 88 that represents pressure. Transitions 90, 92, 94, 96 are provided on curve 84 that represent different stages of an example of operating the system 10 of FIG. 1. A buildup pressure is reflected along the portion of curve from its starting point to transition 90, and which is similar to that of FIG. 7. The portion of curve 84 between transitions 90 and 92 represent a stage when the lift gas 54 is entering the production tubing 26 and lifting the plunger 58 towards the lubricator 64 (FIGS. 4 and 5). The portion of curve 84 between transitions 92 and 94 represents pressure in the production tubing 26 as the produced fluid 62 starts to be produced through production line 34. At transition 94 plunger 58 is entering the lubricator 64. Between transitions 94, 96 curve 84 represents pressure during the period of time when plunger 58 is maintained within lubricator 64 by pressure. In the portion of plot 84 from 96 to its end represent the time after lift gas 54 flow to production tubing 26 is suspended, pressure continues to dissipate through production line 34 and when plunger 58 falls back to its lower most position.

Examples of maximizing a production rate of produced fluid 62 from the wellbore 14 include monitoring a condition or situation in the wellbore 14, and initiating lifting a liquid column 61 based on sensing a target condition or situation. Examples of monitored conditions or situations include wellbore pressure, wellbore temperature, and a flowrate in the wellbore. In a non-limiting example of operation, a production rate of the produced liquid 64 from the well 14 is maximized by monitoring pressure in the production tubing 26 as the liquid column 61 is building on the plunger 58, and lifting the plunger 58 and column 61 when the monitored pressure reaches a target pressure. In an alternative, a trigger for lifting the plunger 58 is based on a flow into the wellbore 14; which as noted above embodiments exist of monitoring pressure to indicate a flowrate of fluid flowing into the wellbore 14.

In a non-limiting example of operation, maximizing a production rate of produced fluid 62 from the wellbore 14 includes obtaining pressure over time of the liquid 22, and using those pressure values to estimate flowrates over time of liquid 22 flowing into the wellbore 14. In this example, the pressure and flowrate values are graphically organized similar to that of FIG. 7. Based on the pressure and flowrate values, a production rate of produced fluid 62 is estimated for various buildup times, and where the volume of accumulated liquid 22 is based on pressure information at that particular buildup time, such as the information illustrated in FIG. 7. The volume of produced fluid 62 produced with each cycle is based on the known elevational locations of where the pressure inside the liquid 22 is obtained and the upper end of the plunger 58, and the cross sectional area inside the production tubing 26. Based on the selected buildup time, the corresponding total cycle time Tc (FIG. 8) is determined. In this example, the number of cycles are the same for each buildup time. The production rate is maximized by operating at a buildup time shown to produce the largest production rate of produced fluid.

In an embodiment, the values of pressure over time for the wellbore 14 are obtained real time. In this embodiment, the curves 74, 80 are extrapolated into the future and a determination of when to initiate lift gas injection is based on current pressure monitoring. Alternatively, the pressure and time values of FIG. 7 are historical data obtained from the wellbore 14. Optionally, the analysis of determining when to initiate lift gas injection is based on historical and real time data.

In an alternative, the buildup times considered are limited to a region of optimal time $T_o$ along curve 80 where the flowrate is approaching a negligible value and pressure changes are small. As previously indicated most of the liquid 22 accumulates early in buildup time span and little additional liquid buildup occurs later.

In another non-limiting example of operation, the time to initiate injection of lift gas 54 is set to the time where pressure over time of the buildup liquid approaches or is the same as zero. In another example, the time to initiate injection of lift gas 54 is based on an analysis of curve 74, and set to where the curvature of curve 74 is at a maximum.

It should also be noted that for the purposes of discussion a production rate is distinguishable from a flowrate. In the context of the examples herein a production rate refers to an amount of produced fluid 62 extracted from the wellbore 14 over a period of time; where examples of a period of time include hours, days, weeks, months, years, and combinations. Examples of amount include mass, total mass, volume, total volume, and combinations. Examples exist that the production rate of the produced fluid 62 is simply a total amount, or an amount averaged over time. Whereas the term flowrate in this example refers to an amount a substance is flowing over a discrete period of time.

Figure 9:
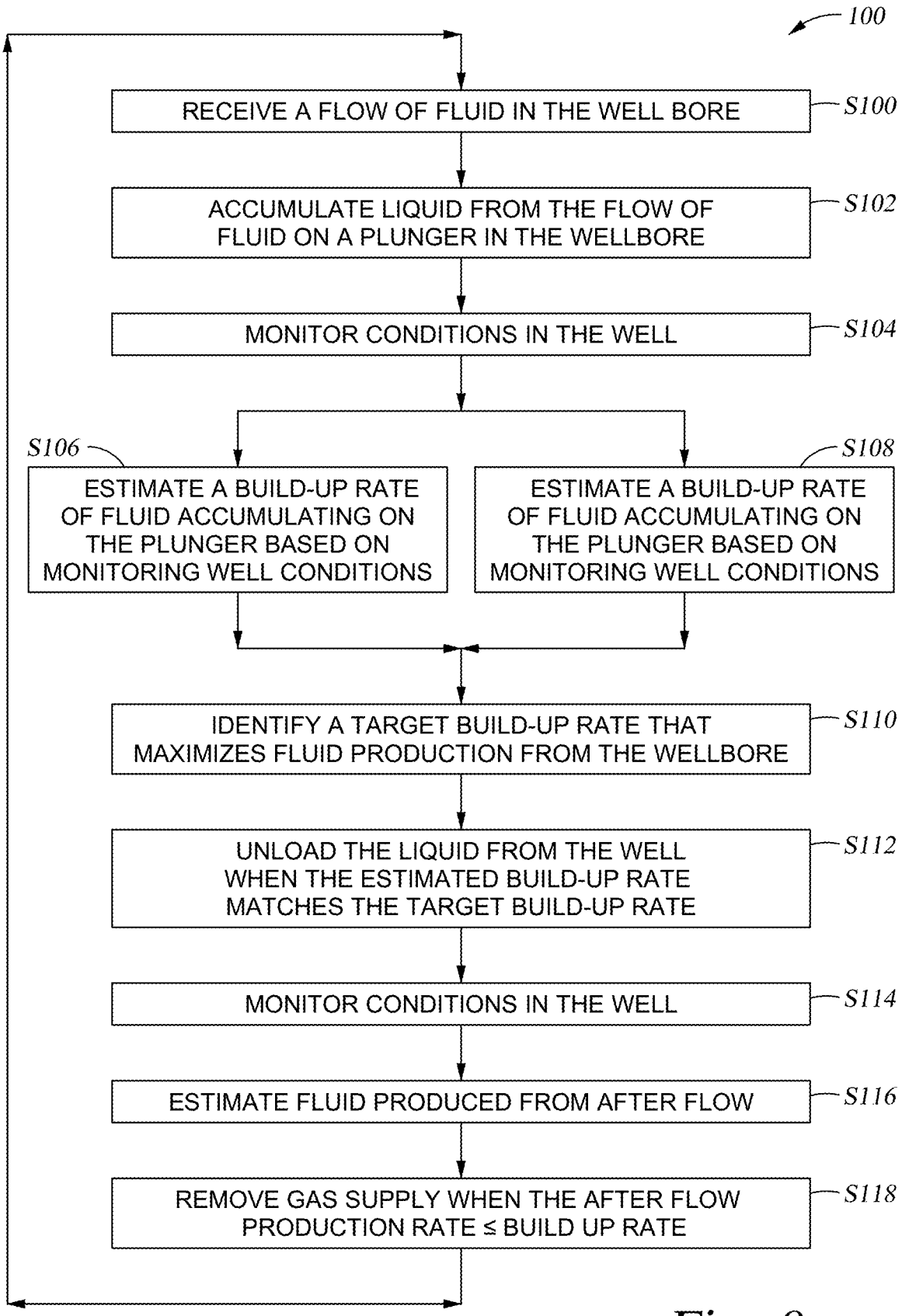
FIG. 9 is a schematic representation of a flow chart having an example of operation of the hydrocarbon producing wellbore of FIG. 1.

Referring now to FIG. 9, shown is a flow chart having example steps undertaken while operating the system 10 of FIG. 1. In step S100 a flow of fluid is being received in the wellbore 14, and which shown in step S102 accumulates on a plunger 58 in the wellbore 14. Concurrently with steps S100, S102, in step S204 conditions in the wellbore 14 are being monitored. Based upon the monitoring in step S104, a buildup rate of the fluid accumulated on the plunger 58 is estimated based on monitoring wellbore conditions; which is reflected in step S106. Alternatively, in step S108 the buildup rate of fluid accumulated on the plunger 58 is estimated based on historical data. Both steps S106 and S108 yield the ability to identify a target buildup rate that maximizes fluid production from the wellbore 14 as shown in step S110. Knowing the target buildup rate for maximizing fluid production from the wellbore reflected from step S110, when the estimated buildup rate matches the target buildup rate as illustrated in step S112 the liquid is unloaded from the wellbore 14 by lifting the plunger 58 and produced fluid 61 to wellhead assembly 32. After the liquid is unloaded in step S112 and while the plunger 58 remains above the production line 34, in step S114 conditions (such as pressure) in the wellbore 14 are monitored. An "after flow" of liquid being produced is estimated based on the measured pressure in the wellbore 14. An example of after flow is a rate of liquid 22 flowing with the lift gas 54. Reflected in step S118, the supply of lift gas 54 is suspended with the rate of after flow is equal to or less than an average rate of liquid 22 flowing into the wellbore 14 during the buildup phase. The unloading technique described herein is a repeatable occurrence, and after step S118 returns back to step S100 to repeat the process.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. In an alternate example, multiple valves 36 and corresponding valve actuators 38 are included with system 10. These and other similar modifications will readily suggest themselves to those skilled in the art, and are intended to be encompassed within the spirit of the present invention disclosed herein and the scope of the appended claims.

What is claimed is:

1. A method of producing from a wellbore comprising:

receiving into the wellbore a flow of fluid that comprises a liquid and forms an accumulation of liquid on a plunger in the wellbore;

producing the liquid from the wellbore with cycles of lift gas injection into the wellbore that lift the plunger and accumulation of liquid to surface;

obtaining an anticipated rate of flow of liquid into the wellbore;

identifying times for initiating the cycles to produce a maximum amount of the liquid based on the anticipated rate of flow of liquid into the wellbore; and maximizing a rate of liquid being unloaded from the wellbore by initiating the cycles at the identified times.

2. The method of claim 1, wherein the anticipated rate of flow of liquid is based on measured changes of static head pressure of the accumulation of liquid on the plunger.

3. The method of claim 2, wherein the static head pressure is monitored over time, and a subsequent cycle is initiated when a rate of change of the static head pressure over time approaches zero.

4. The method of claim 1, wherein the anticipated rate of flow of liquid is based on historical data.

5. The method of claim 4, wherein a subsequent cycle is initiated when the anticipated rate of flow of liquid approaches zero.

6. The method of claim 2, wherein the plunger is disposed in production tubing that is installed in the wellbore, and wherein the changes of static head pressure are monitored by sensing pressure inside the production tubing over a period of time the liquid is accumulating on the plunger.

7. The method of claim 6, wherein the lift gas is injected into the production tubing below the plunger.

8. The method of claim 7, further comprising maintaining lift gas in an annulus between the production tubing and sidewalls of the wellbore during and between cycles of lift gas injection.

9. The method of claim 1, wherein the fluid comprises the liquid and a produced gas that flow from a formation adjacent the wellbore, and wherein the liquid and the produced gas each comprise hydrocarbons.

10. The method of claim 9, wherein a wellhead assembly is provided on surface at an upper end of production tubing disposed in the wellbore, and wherein the accumulation of liquid and produced gas flow through the production tubing and to the wellhead assembly.

11. A method of producing from a wellbore comprising:

obtaining flowrates of a liquid accumulating in the wellbore over a period of time that the wellbore is being loaded with the liquid;

estimating rates of liquid production from the wellbore by initiating a cycle of unloading the wellbore for the flowrates of the liquid accumulating in the wellbore;

identifying a maximum from the rates of liquid production from the wellbore to define a maximum liquid production rate;

identifying a flowrate of the liquid accumulating in the wellbore that corresponds to the maximum liquid production rate to define a target flowrate;

monitoring conditions in the wellbore to obtain an estimate of a current flowrate of liquid accumulating in the wellbore; and using a plunger and lift gas to unload liquid accumulated in the wellbore when the current flowrate of liquid accumulating in the wellbore is about the same as the target flowrate.

12. The method of claim 11, wherein the plunger is disposed in production tubing installed in the wellbore, and wherein conditions in the wellbore are monitored with a pressure sensor that is in communication with the production tubing.

13. The method of claim 11, wherein obtaining flowrates of a liquid accumulating in the wellbore over a period of time comprises estimating changes in a liquid level of the liquid accumulating in the wellbore based on monitoring pressure in the wellbore over the period of time, and correlating the flowrate of the liquid accumulating in the wellbore to the liquid level changes.

14. The method of claim 13, wherein the flowrates are obtained in real time.

15. The method of claim 13, wherein the flowrates are obtained from historical data.

16. The method of claim 11, wherein the plunger is disposed in production tubing installed in the wellbore, and wherein lift gas is maintained in an annulus between the production tubing and sidewalls of the wellbore prior to and after the step of unloading.

17. The method of claim 11, wherein the plunger is disposed in production tubing installed in the wellbore, and wherein the lift gas is introduced into the production tubing from an annulus between the production tubing and sidewalls of the wellbore through a valve that is selectively actuated in response to a command.

18. A method of producing from a wellbore comprising:

a. receiving liquid in the wellbore flowing from a formation that is intersected by the wellbore, the liquid flowing into the wellbore at a flowrate that diminishes over time, the liquid accumulating on a plunger disposed in production tubing installed in the wellbore, and the accumulated liquid produced from the production tubing by the plunger being raised and lowered inside the production tubing so that a cycle time is defined by the over which the plunger is raised and lowered;

b. estimating amounts of the liquid that accumulate on the plunger over different buildup times, c. obtaining different liquid production values, where each different liquid production value is based on each of the different buildup times, a corresponding amount of the liquid accumulated on the plunger over each of the different buildup times, and the cycle time; and d. operating at a one of the different buildup times that corresponds to a one of the different production value having a maximum value.

19. The method of claim 18, wherein the production value is based on a production rate over a period of time, and wherein the period of time is selected from the group consisting of hours, days, weeks, months, years, and combinations, and wherein.

20. The method of claim 18 further comprising, obtaining pressure values by monitoring pressure in the production tubing at a depth below the plunger while the liquid is accumulating on the plunger; estimating a flowrate of the liquid flowing into the wellbore based on changes in pressure over time.

* * * * *